US006394677B2

(12) United States Patent
Wang

(10) Patent No.: US 6,394,677 B2
(45) Date of Patent: May 28, 2002

(54) HANGING PEN AND CORD THEREOF

(75) Inventor: Thomas Wang, Taipei (TW)

(73) Assignee: Excel Rite Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/729,817

(22) Filed: Dec. 6, 2000

(30) Foreign Application Priority Data

May 10, 2000 (TW) ..... 89207823
Sep. 4, 2000 (TW) ..... 89215323

(51) Int. Cl.[7] ..... B43K 23/08; B43K 29/00

(52) U.S. Cl. ..... 401/6; 24/3.4; 24/3.13; 24/303; 224/183; 335/219; 335/285; 401/98; 401/202

(58) Field of Search ..... 401/6, 98, 131, 401/202, 52, 195; 24/303, 3.13, 3.4; 335/219, 285; D19/44; 224/183, 576, 579, 200, 601, 671, 613, 614, 672, 673, 675, 251, 260

(56) References Cited

U.S. PATENT DOCUMENTS 4,168,129 A * 9/1979 Herrnring ..... 401/213 X
5,379,928 A * 1/1995 Mikkelsen ..... 224/614 X
D370,497 S * 6/1996 Moore et al. ..... D19/44 X

* cited by examiner

*Primary Examiner*—Gregory Huson
*Assistant Examiner*—Kathleen J. Prunner
(74) *Attorney, Agent, or Firm*—Troxell Law Office PLLC

(57) ABSTRACT

A pen having a pen cap, and a penholder. The pen cap has a blocking cover with a loop cord for carrying and an opening at the other end. The penholder provides a center stick therein with a writing head of the center stick extending outwardly from a conical part at an end of the penholder. A magnetic ring is fixed in the pen cap. The conical part is made of magnet inducing material. The pen cap engages the penholder by way of the magnetic ring attracting the conical part when the conical part is inserted into the pen cap from the open end.

11 Claims, 7 Drawing Sheets

HANGING PEN AND CORD THEREOF

BACKGROUND OF THE INVENTION

1. Field of the Invention

The present invention relates to a pen having an attached neck cord. In particular, the present invention relates to a pen, which has a pen cap with a loop cord having a magnetic ring therein to attract a conical end part made of magnet inducing material on a penholder for performing an engagement of the pen cap and the penholder. In addition, a cord for the pen is provided with a connecting device, which may disengage automatically for the safety of the wearer in case of being pulled by an external force.

2. Description of Related Art

It is known that the pen plays an important role in the progressive development of mankind. Presently, the pen has a variety of aspects in function and configuration because of high development of material science and machining technology. Generally, based on the structure, the pen can be classified into different types such as pencil, regular ball pen, fountain pen, steel ball pen, etc. It also can be classified by way or purpose such as providing illumination, displaying time, enhancing amusement, identifying status, pursuing commercial sale, etc. No doubt, writing is still a fundamental function of the pen.

In fact, carrying is another consideration in addition to the function of writing in accordance with purpose and way in use. Because the pen is used anywhere and at anytime, the most popular way for carrying is a pen cap or a pen clip arranged on the pen. When not in use, the pen can be clipped on an upper pocket of clothing. But, clipping the pen on a pocket is inconvenient for a woman. Hence, a pen having a neck cord has been developed primarily having a pen cap attached with a cord and the pen cap engages the penholder by way of a locking device or a threaded fastener. This pen can be hung in front of the chest and the penholder is separated from the pen cap in case of the pen being used. Accordingly, the pen with a neck cord is much more convenient for the user.

The pen with a neck cord can be classified into two categories based on the type of cord. One of these two categories is with a connecting device and the other one is without a connecting device. For the cord without a connecting device, the loop enclosed by the cord has to have a loop size greater than the head for wearing and taking off the hanging pen. But it is unfavorable for using the pen if the loop size is overlarge. For the cord with the connecting device, it is easier that both free ends of the cord can be engaged with each other while the user is going to wear the hanging pen. The loop size can be changed optionally. Once both ends of the cord are disengaged, the pen can be conveniently taken off. But, the connecting device also has a disadvantage in that the engagement of the both ends of the cord is by way of a locking device or threaded fastener. When the hanging pen is pulled or bound tightly by an external force, injury or suffocation may occur. Therefore, the defect of the connecting device of the prior art needs to be overcome.

SUMMARY OF THE INVENTION

An object of the present invention is to provide a pen with an attached neck cord, which has a pen cap with loop cord having a magnetic ring therein to attract a conical end part made of magnet inducing material on a penholder for performing an engagement of the pen cap and the penholder.

Another object of the present invention is to provide a cord for the preceding pen, which has a connecting device, which may disengage automatically for the safety of the wearer in case of being pulled by an external force.

BRIEF DESCRIPTION OF DRAWINGS

The present invention can be more fully understood by referring to the following description and accompanying drawing, in which.

DETAILED DESCRIPTION OF THE PREFERRED EMBODIMENTS

Figure 1:
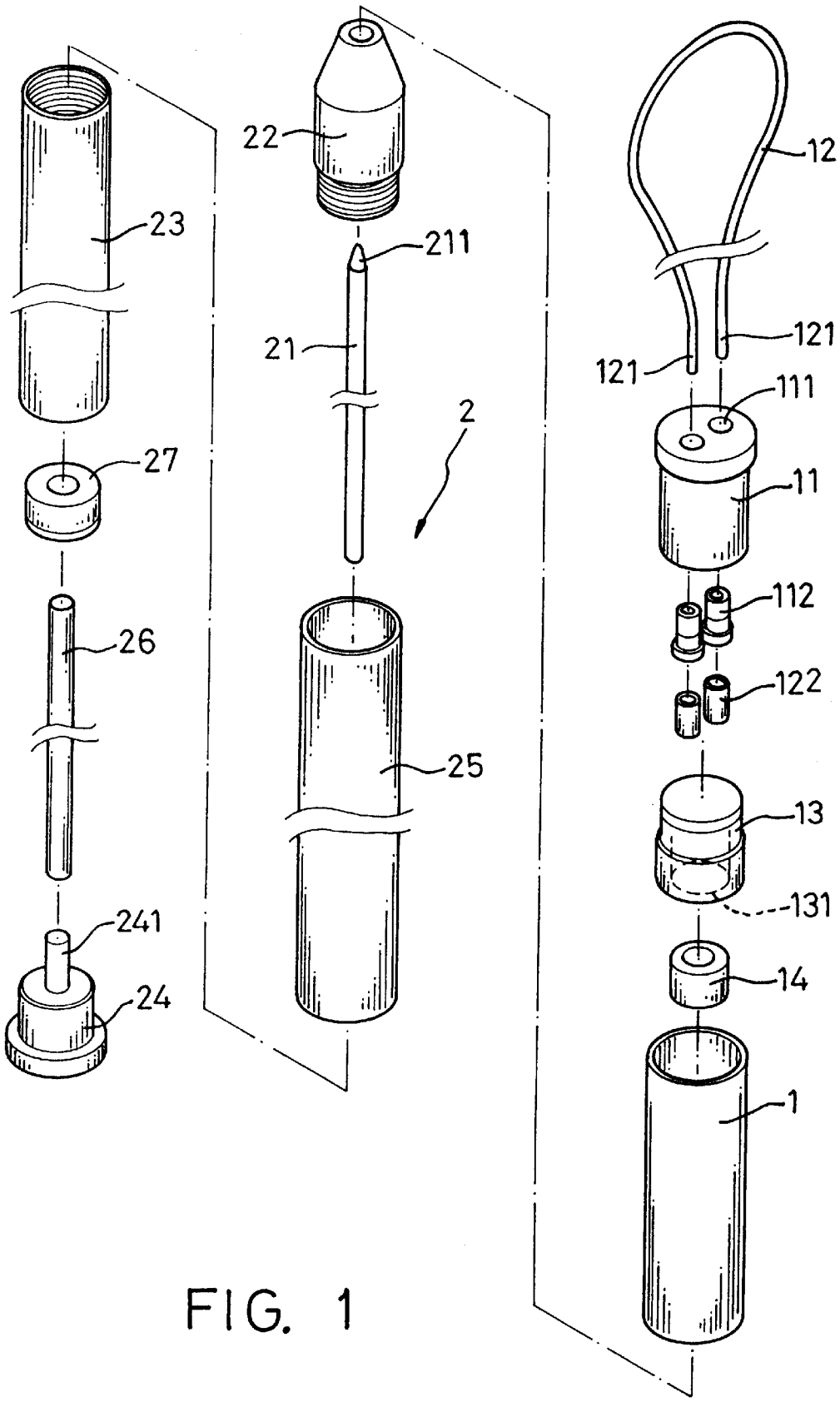
FIG. 1 is an exploded perspective view of a pen according to the present invention.
Figure 2:
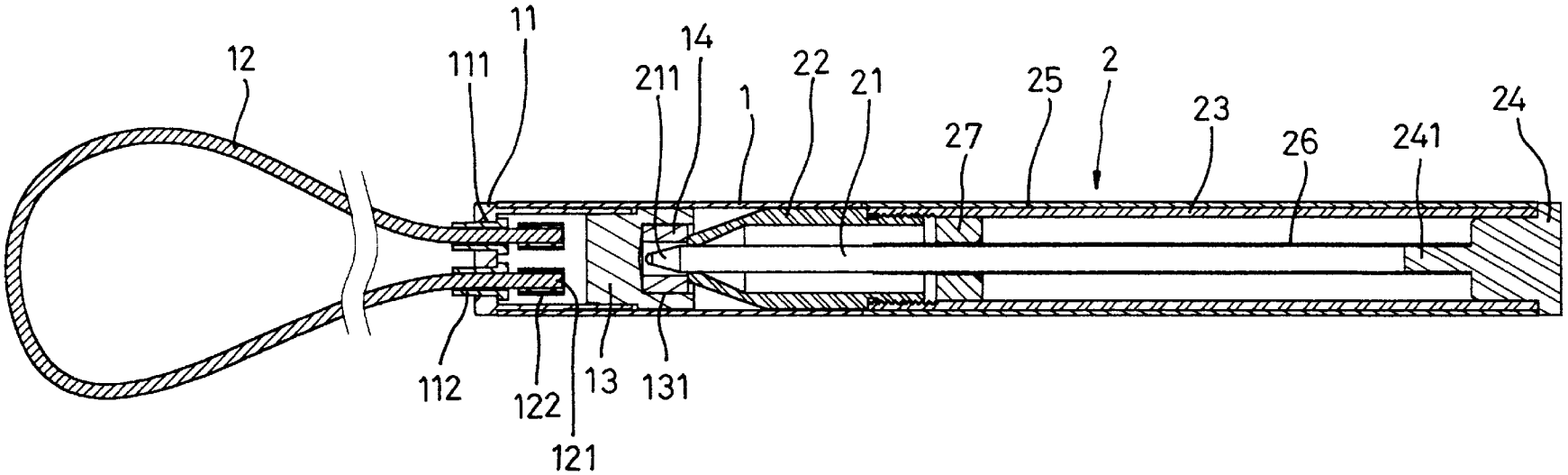
FIG. 2 is a sectional view of the pen shown in FIG. 1 after assembling.
Figure 3:
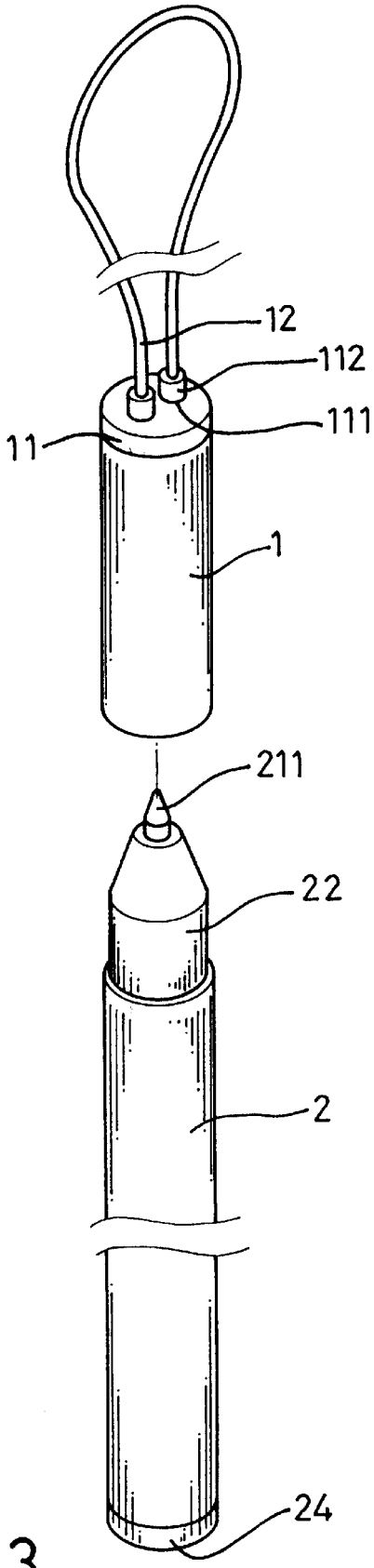
FIG. 3 is a perspective view illustrating a penholder and a pen cap shown in FIG. 1 being in a state of being disengaged from each other.

Referring to FIGS. 1 to 3, a pen according to the present invention basically comprises a pen cap 1 and a penholder 2.

The pen cap 1 is hollow tube and an end thereof has a blocking plug 11 with cord holes 111 for both free ends of a cord 12 piercing through and fixed therein. Hence, the cord 12 can be fixedly attached to the end of pen cap 1 for a user to carry the pen. In practice, the cord 12 is preferably a cable and free ends 121 thereof are passed through two cord holes 111 such that each free end can fix to a fixing piece 112 and join with a hollow cylinder 122 respectively. When these two hollow cylinders 122 press against the respective fixing piece 112, the pen cap 1 and the cord 12 are kept in a state of firm engagement. The pen cap 1 is provided with an intermediate engaging part 13 therein at the middle section thereof and the intermediate engaging part 13 has a fitting hole 131 corresponding to the opening end of the pen cap 1. A magnetic ring 14, such as permanent magnet, is provided in the fitting hole and the intermediate engaging part 13 is made of metal with magnet guide such as the cast iron to avoid the magnetic force affecting articles around the pen cap 1.

The penholder 2 is provided with a center stick 21 therein and a conical part 22 at the front end of penholder 2 is made of magnet inducing material, which is different from the prior art. When the conical part 22 is sleeved in the pen cap 1, the magnetic ring 14 attracts the conical part 22 and a writing head 211 on the center stick 21 is received in the magnetic ring 14. In this way, it is not possible for the penholder 2 to disengage from the pen cap 1.

In practice, an inner tube 23 in the penholder 2 has an end thereof to connect with the conical part 22 and has the other end thereof blocked by a plug 24. The center stick 21 is disposed between the conical part 22 and plug 24. In order to enhance the integral sense of beauty for the penholder 2 and pen cap 1, an outer tube 25, which is made of the same material as the pen cap 1, fits with the outer surface of the inner tube 23. Moreover, a post 241 extending from the plug 241 may be provided to enhance the locating effect of the center stick 21. The post 241 engages with a hard adapting tube 26 and the adapting tube 26 passes through a guide washer 27 in the inner tube 23. Then, the center stick 21 is inserted into the adapting tube 26 to press against the post 241 so that the assembling job of the center stick 21 is finished.

Referring to FIGS. 2 and 3 again, once the pen of the present invention has been set up completely, the user can hold the pen cap 1 with a hand and the penholder 2 with another hand slightly forcedly before writing. The penholder 2 may release from the pen cap 1 for writing as soon as the external force is greater than the attraction between the magnetic ring 14 and the conical part 22. When the pen is not in use, only placing the penholder 2 at the opening of the pen cap 2 and the magnetic ring 14 may attract the conical part 22 tightly to join the penholder 2 and the pen cap 1 together.

Figure 4:
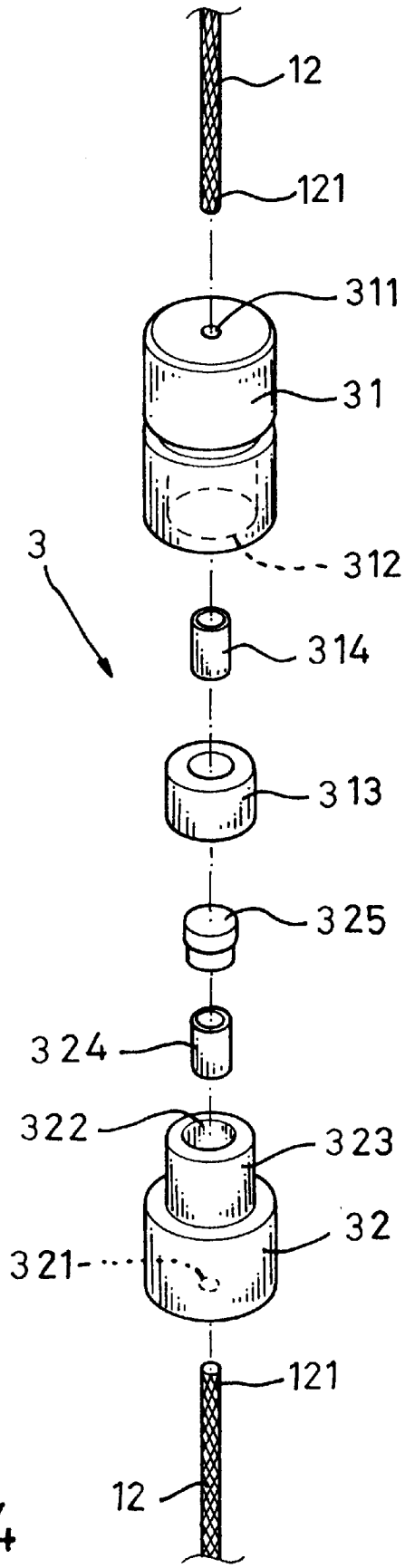
FIG. 4 is an exploded perspective view of a cord device according to the present invention.
Figure 5:
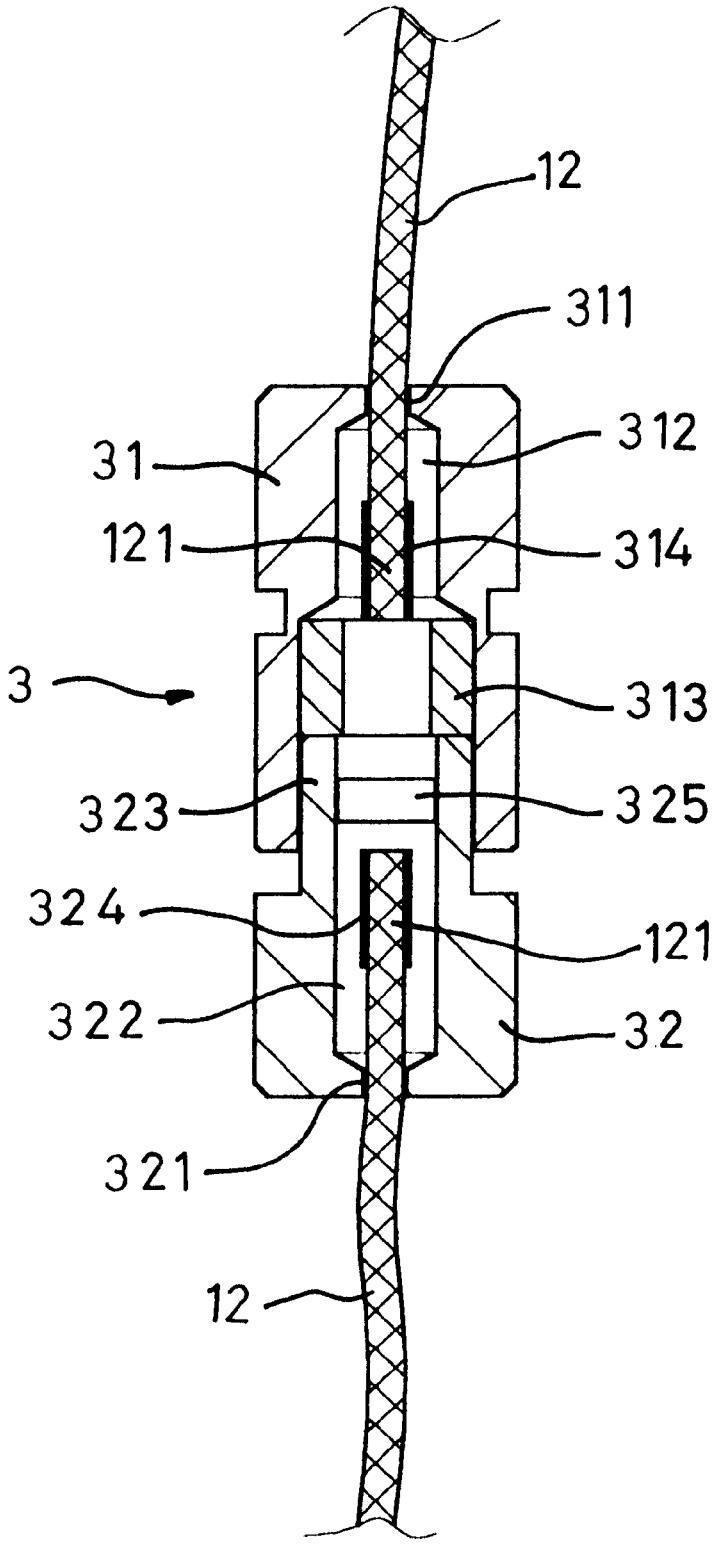
FIG. 5 is a sectional view of the cord shown in FIG. 4 after assembling.

Referring to FIGS. 4 and 5, the cord 12 has two free ends 121 as the preceding description and a connection device 3 connects these two free ends 121 to form a loop. In practice, the cord 12 can be any flexible cord possible to constitute a loop such as a chain, a cloth belt, a cable, etc.

The connection device 3 comprises a fixing adapter 31 and a connecting adapter 32. The fixing adapter 31 at an end thereof has a through aperture 311 to communicate with a stepped hole 312. One of free ends 121 on the cod 12 passes through the through aperture 311 and is fixed in the stepped hole 312. The free end 121 is joined to a fitting tube 314 and the fitting tube 314 has a size greater than the through aperture 311 to prevent the free end 121 from moving away the through aperture 311. A magnetic ring 313 such as a permanent magnet ring is placed in the stepped hole 312. The fixing adapter 31 is made of magnet inducing material such as cast iron to limit the magnetic inductance of the magnetic ring 313 acting toward the opening of the stepped hole 312 only. In this way, other articles carried by us cannot be affected by the magnetic force of the magnetic ring 313.

The connecting adapter 32 is a stepped tube with the same outer diameter as the fixing adapter 31. The connecting adapter 32 at an end thereof has a pierced aperture 321 to communicate a tube hole 322. Another free end 121 of the cord 12 passes through the pierced aperture 321 and fixing in the tube hole 322. Said another free end 121 is joined to a bushing tube 324 and the bushing tube 324 has a size slightly greater than the pierced aperture 321 to prevent said another end from moving away the pierced aperture 321. The connecting adapter 32 at another end thereof is provided with an engaging ring 322 corresponding to the stepped hole 312 and the engaging ring 322 is made of magnet inducing material. While the engaging ring 322 is inserted into the stepped hole 312, the magnetic ring 313 attracts the engaging ring 322 and it constitutes an engagement of the fixing adapter 31 and the connecting adapter 32. In addition, a plug 325 may be used for blocking the opening of the tube hole 322 to avoid said another free end 121 and the bushing tube 324 extending outward form the tube hole 322.

Figure 6:
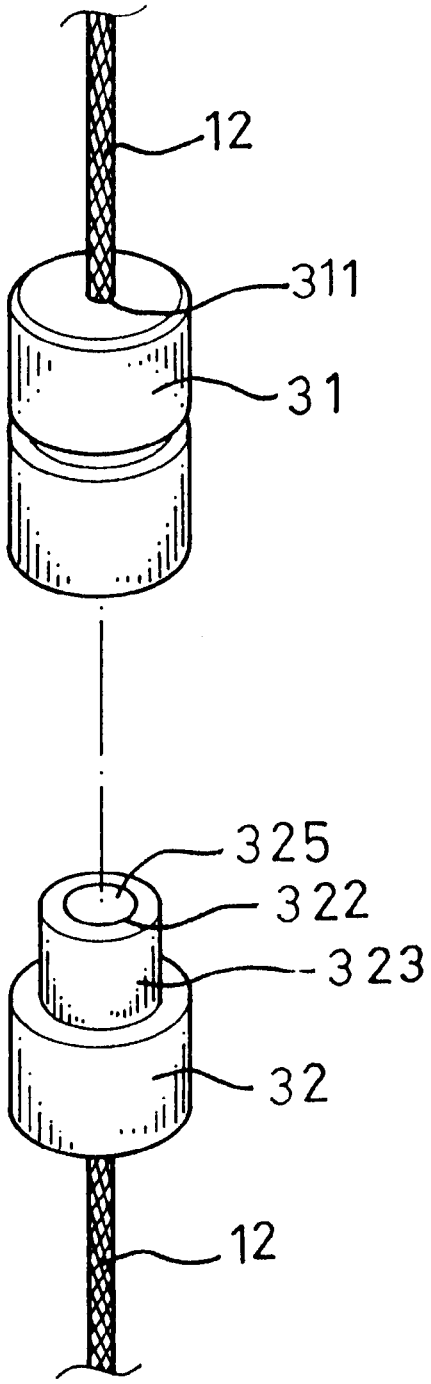
FIG. 6 is a perspective view of the cord shown in FIG. 4 after assembling illustrating in a state of being detached.

Referring to FIGS. 4 to 6, the fixing adapter 31 and the connecting adapter 32 are fixedly attached to these two free ends respectively. In order to join the fixing adapter 31 and the connecting adapter 32, it is only necessary for the engaging ring 323 to align with the and be placed in the stepped hole 312. Thus, the magnetic ring 313 may attract the engaging ring 323 to have the cord 12 enclose a loop for carrying. While the joined fitting adapter 31 and the connecting adapter 32 is going to be disengaged, an exerted external force is slightly acted and the disengagement may be performed as soon as the external force is greater than the attraction between the magnetic ring 313 and the engaging ring 323.

Figure 7:
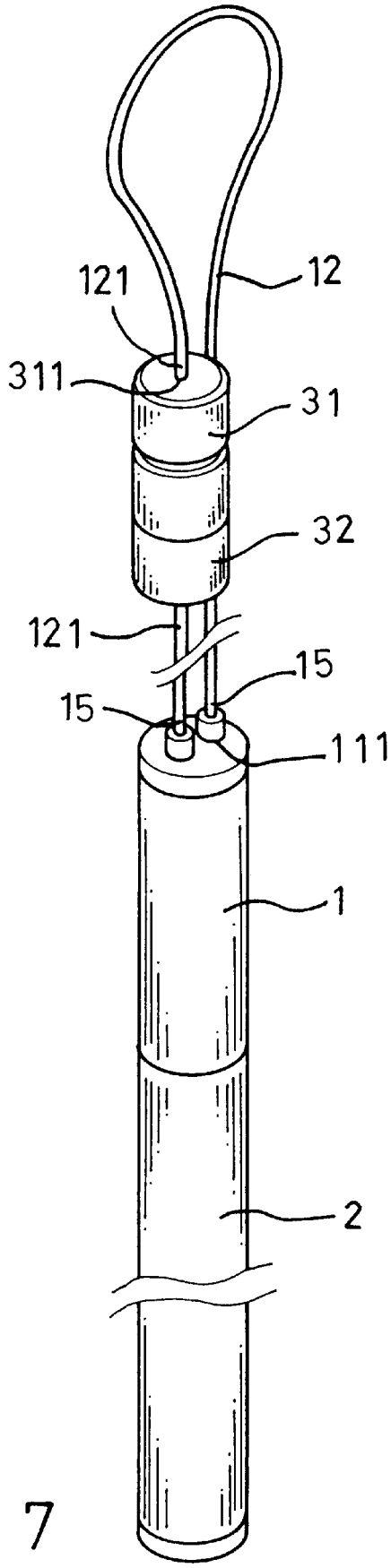
FIG. 7 is a perspective view of the pen shown in FIG. 1 with the cord according to the present invention in practice.

Referring to FIG. 7 again, an embodiment of the cord 12 is illustrated for the hanging pen shown in FIG. 1. A free end 121 on the cord 12 passes through two cord holes 111 in the pen cap 1 first and then fixedly attached to the connecting device 3. Alternatively, both free ends 121 on the cord 12 pivotally connect with the connecting device 3 and another two connecting ends 15 are joined to the pen cap 1 for obtaining the function of hanging.

It can be understood from the preceding explanation of preferred embodiment that the present invention has a lot of advantages. The pen cap and the penholder can pivotally engage with each other by way of the attracting action between the magnetic ring and the conical part. Therefore, the engagement of the pen cap and the penholder is faster than engaging way such as locking device or screw fasteners used in the conventional hanging pen. An intermediate engaging part is arranged in the present invention to direct the magnetic force of the magnetic ring toward the opening of the pen cap only such that there is no magnetic force to affect the user of the pen. Furthermore, once the connecting device of the cord is going to engage with each other, it is necessary to align the engaging ring of the connecting adapter with the stepped hole of the fixing adapter only. Thus, the magnetic ring therein may attract the engaging ring to constitute an automatic engagement to avoid the trouble such as hard engagement and disengagement or hard alignment existing in the prior art. In addition, once an external force is greater than the attraction force between the magnetic ring and the engaging ring, the connecting device may separate automatically to avoid the hurt of the neck.

While the invention has been described with reference to preferred embodiments thereof, it is to be understood that modifications or variations may be easily made without departing from the spirit of this invention, which is defined by the appended claims.

What is claimed is:

1. A pen with an attached neck cord, comprising:

a pen cap with an open end and an opposite end having a blocking plug, the blocking plug being provided with two cord holes, each cord hole having a fixing piece disposed therein, the neck cord having two free ends with each end passing through a respective fixing piece, each of said two free ends joining a hollow cylinder which presses against the respective fixing piece so as to prevent the neck cord from moving away from the pen cap, and a magnetic ring being fixed in the pen cap; and a penholder provided with a center stick having a writing head at one end, an inner tube having one end joining a conical part and another end blocked with a plug, the conical part being made of magnet inducing material, the writing head extending outward from the conical part such that when the conical part is inserted into the pen cap through the open end thereof it is attracted by the magnetic ring so as to engage the pen cap with the penholder by magnetic force.

2. The pen with an attached neck cord according to claim 1, wherein the magnetic ring is received in an intermediate engaging part adapted to direct the magnetic force toward the open end of the pen cap.

3. The pen with an attached neck cord according to claim 1, wherein the inner tube fits within an outer tube formed of the same material as the pen cap.

4. The pen with an attached neck cord according to claim 1, wherein the plug of the penholder has a post extending outward to engage with an adapting tube, and the center stick is sleeved in the adapting tube to press against the post.

5. The pen with an attached neck cord according to claim 4, wherein the adapting tube passes through a guide washer located in the inner tube for locating the adapting tube.

6. A cord adapted to be attached to a pen for suspending the pen therefrom, the cord comprising:

two free ends; and a connecting device including:

a fixing adapter provided with a through aperture at one end and a stepped hole at its opposite end, the stepped hole having a magnetic ring located therein, the stepped hole communicating with the through aperture, one of said two free ends passing through the through aperture and being fixed in the stepped hole; and a connecting adapter provided with a pierced aperture at one end and a tube hole at its opposite end, the tube hole communicating with the pierced aperture, the other of said two free ends passing through the pierced aperture and being fixed in the tube hole, and the opposite end of the connecting adapter defining an engaging ring extending outward to correspond in size to the stepped hole and being made of magnet inducing material whereby when the engaging ring is inserted into the stepped hole it is attracted by the magnetic ring so as to join both ends of the cord together by magnetic force so as to form a closed loop.

7. The cord of claim 6, wherein said one of said two free ends joins a fitting tube and the other of said two free ends joins a bushing tube such that said free ends are prevented from moving away from said through aperture and said piercing aperture, respectively.

8. The cord of claim 7, wherein the tube hole of the connecting adapter is blocked by a plug so as to prevent said other of said two free ends and the bushing tube from passing through the tube hole.

9. The cord of claim 6, wherein the cord is one of a chain, a cloth belt, or a cable.

10. The cord of claim 6, wherein one of said two free ends is connected to another free end adapted to pass through a pen cap and then connect with the connecting device.

11. The cord of claim 6, wherein the cord provides another pair of free ends adapted to connect with a pen cap of a pen.

* * * * *